US010488775B2

(12) United States Patent
Ogawa

(10) Patent No.: US 10,488,775 B2
(45) Date of Patent: Nov. 26, 2019

(54) POSITIVELY CHARGEABLE TONER

(71) Applicant: KYOCERA Document Solutions Inc., Osaka (JP)

(72) Inventor: Tomoyuki Ogawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/294,409

(22) Filed: Mar. 6, 2019

(65) Prior Publication Data

US 2019/0285999 A1 Sep. 19, 2019

(30) Foreign Application Priority Data

Mar. 13, 2018 (JP) ..... 2018-045375

(51) Int. Cl.
*G03G 9/093* (2006.01)

(52) U.S. Cl.
CPC ..... *G03G 9/09321* (2013.01); *G03G 9/09328* (2013.01); *G03G 9/09342* (2013.01); *G03G 9/09371* (2013.01); *G03G 9/09385* (2013.01)

(58) Field of Classification Search
CPC ..... G03G 9/09321; G03G 9/09342; G03G 9/09371; G03G 9/09385; G03G 9/09328
USPC ..... 430/110.2
See application file for complete search history.

(56) References Cited

U.S. PATENT DOCUMENTS 10,054,867 B2 * 8/2018 Nishitera ..... G03G 9/08793
2005/0142476 A1 * 6/2005 Kim ..... G03G 9/0819 430/108.4
2005/0271964 A1 12/2005 Etou et al.

FOREIGN PATENT DOCUMENTS

JP 2004-294469 A 10/2004

* cited by examiner

*Primary Examiner* — Janis L Dote
(74) *Attorney, Agent, or Firm* — Studebaker & Brackett PC

(57) ABSTRACT

A positively chargeable toner includes toner particles. Each of the toner particles includes a composite core and a shell layer covering a surface of the composite core. Each of the composite cores is a composite of a toner core containing a binder resin and a colorant layer disposed over a surface of the toner core. The colorant layers contain carbon black. The colorant layers have a thickness of at least 200 nm and no greater than 500 nm. The shell layers include a repeating unit having a non-ring-opened oxazoline group. An amount of the non-ring-opened oxazoline group contained in 1 g of the positively chargeable toner as measured by gas chromatography-mass spectrometry is at least 500 μmol and no greater than 1,000 μmol.

6 Claims, 1 Drawing Sheet

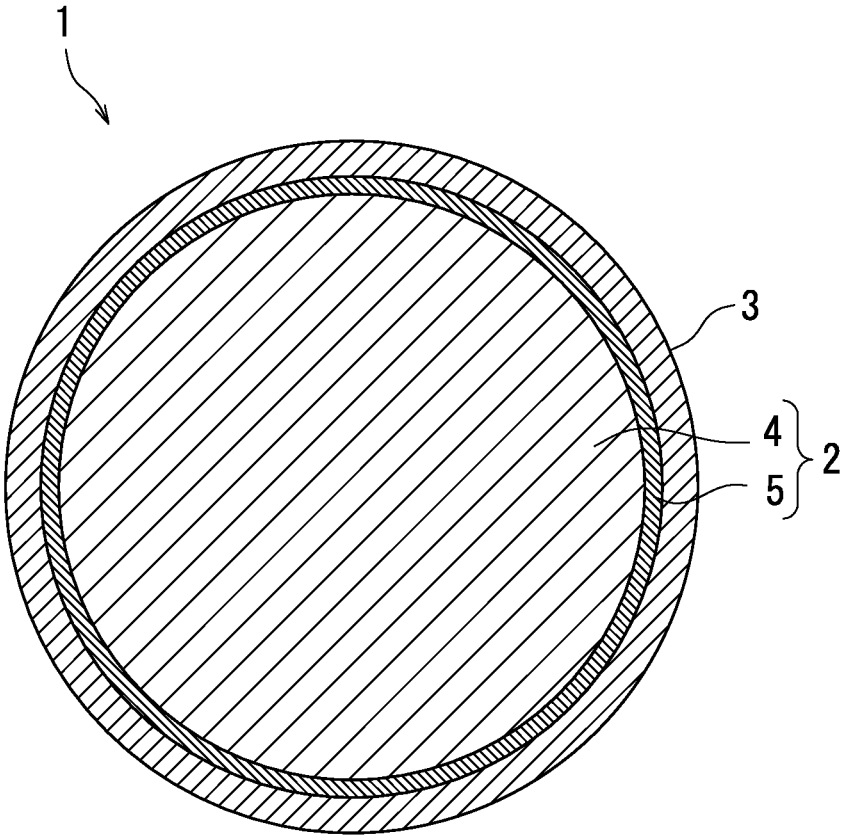
1
3
4
5
2

POSITIVELY CHARGEABLE TONER

INCORPORATION BY REFERENCE

The present application claims priority under 35 U.S.C. § 119 to Japanese Patent Application No. 2018-045375, filed on Mar. 13, 2018. The contents of this application are incorporated herein by reference in their entirety.

BACKGROUND

The present disclosure relates to a positively chargeable toner.

A known toner includes toner particles each including a toner core and a shell layer covering a surface of the toner core. The toner can exhibit improved heat-resistant preservability through the shell layer covering the toner core.

SUMMARY

A positively chargeable toner according to an aspect of the present disclosure includes toner particles. Each of the toner particles includes a composite core and a shell layer covering a surface of the composite core. Each of the composite cores is a composite of a toner core containing a binder resin and a colorant layer disposed over a surface of the toner core. The colorant layers contain carbon black. The colorant layers have a thickness of at least 200 nm and no greater than 500 nm. The shell layers include a repeating unit having a non-ring-opened oxazoline group. An amount of the non-ring-opened oxazoline group contained in 1 g of the positively chargeable toner as measured by gas chromatography-mass spectrometry is at least 500 μmol and no greater than 1,000 μmol.

BRIEF DESCRIPTION OF THE DRAWINGS

FIGURE illustrates an example of a cross-sectional structure of a toner particle included in a positively chargeable toner according to an embodiment of the present disclosure.

DETAILED DESCRIPTION

The following describes a preferred embodiment of the present disclosure. A toner is a collection (for example, a powder) of toner particles. An external additive is a collection (for example, a powder) of external additive particles. Unless otherwise stated, evaluation results (for example, values indicating shape and physical properties) for a powder (specific examples include a powder of toner particles) are each a number average of values measured for a suitable number of particles selected from the powder.

A value for volume median diameter ($D_{50}$) of a powder is measured using a laser diffraction/scattering particle size distribution analyzer ("LA-950", product of Horiba, Ltd.), unless otherwise stated. A number average primary particle diameter of a powder is a number average of equivalent circle diameters of primary particles (Heywood diameter: diameters of circles having the same areas as projected areas of the primary particles) measured using a scanning electron microscope, unless otherwise stated. A number average primary particle diameter of a powder is for example a number average of equivalent circle diameters of 100 primary particles of the powder.

Chargeability refers to chargeability in triboelectric charging, unless otherwise stated. Strength of positive chargeability (or strength of negative chargeability) in triboelectric charging can be confirmed from a known triboelectric series or the like. A measurement target (for example, a toner) is triboelectrically charged for example by mixing and stirring the measurement target with a standard carrier (N-01: a standard carrier for a negatively chargeable toner, P-01: a standard carrier for a positively chargeable toner) provided by The Imaging Society of Japan. An amount of charge of the measurement target is measured before and after the triboelectric charging using for example a charge meter (Q/m meter). A measurement target having a larger change in amount of charge before and after the triboelectric charging has stronger chargeability.

A value for a softening point (Tm) is measured using a capillary rheometer ("CFT-500D", product of Shimadzu Corporation), unless otherwise stated. On an S-shaped curve (horizontal axis: temperature, vertical axis: stroke) plotted using the capillary rheometer, the softening point (Tm) is a temperature corresponding to a stroke value of "(base line stroke value+maximum stroke value)/2". A value for a melting point (Mp) is a temperature of a peak indicating maximum heat absorption on a heat absorption curve (vertical axis: heat flow (DSC signal), horizontal axis: temperature) plotted using a differential scanning calorimeter ("DSC-6220", product of Seiko Instruments Inc.), unless otherwise stated. Such an endothermic peak results from melting of a crystalline region. A value for a glass transition point (Tg) is measured in accordance with "Japanese Industrial Standard (JIS) K7121-2012" using a differential scanning calorimeter ("DSC-6220", product of Seiko Instruments Inc.), unless otherwise stated. On a heat absorption curve (vertical axis: heat flow (DSC signal), horizontal axis: temperature) plotted using the differential scanning calorimeter, a temperature at a point of inflection caused due to glass transition (specifically, a temperature at an intersection point between an extrapolation of a base line and an extrapolation of an inclined portion of the curve) corresponds to the glass transition point (Tg).

The term "main component" of a material used herein refers to a component that accounts for the largest proportion of the mass of the material, unless otherwise stated.

An acid value is measured in accordance with "Japanese Industrial Standard (JIS) K0070-1992", unless otherwise stated.

Hereinafter, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. The term "(meth)acryl" may be used as a generic term for both acryl and methacryl. The term "(meth) acrylonitrile" is used as a generic term for both acrylonitrile and methacrylonitrile. An organic group "optionally substituted with a substituent" means that some or all of hydrogen atoms of the organic group may each be replaced with a substituent. An organic group "optionally substituted with a phenyl group" means that some or all of hydrogen atoms of the organic group may each be replaced with a phenyl group.

<Positively Chargeable Toner>

A positively chargeable toner (also referred to below simply as a toner) according to the present embodiment can for example be favorably used in development of electrostatic latent images. The toner according to the present embodiment is a collection (for example, a powder) of toner particles (particles each having features described below). The toner may be used as a one-component developer.

Alternatively, a two-component developer may be prepared by mixing the toner and a carrier using a mixer (specific examples include a ball mill). The toner according to the present embodiment is positively charged by friction with a carrier, a development sleeve, or a blade in a developing device.

The toner particles included in the toner according to the present embodiment each include a composite core and a shell layer covering a surface of the composite core. Each of the composite cores is a composite of a toner core containing a binder resin and a colorant layer disposed over a surface of the toner core. The colorant layers contain carbon black. The colorant layers have a thickness of at least 200 nm and no greater than 500 nm. The shell layers include a repeating unit having a non-ring-opened oxazoline group. An amount of the non-ring-opened oxazoline group (also referred to below as a non-ring-opened oxazoline group content) in 1 g of the toner as measured by gas chromatography-mass spectrometry is at least 500 μmol and no greater than 1,000 μmol. The colorant layer thickness and the non-ring-opened oxazoline group content are measured by the same methods described below in association with Examples or methods conforming therewith. Hereinafter, the term "oxazoline group" refers to "non-ring-opened oxazoline group", unless otherwise stated.

The toner according to the present embodiment having the above-described features can exhibit improved positive chargeability and improved black color developing ability while maintaining its low-temperature fixability. The reason for the above is thought to be as follows.

The toner particles included in the toner according to the present embodiment each include a composite core, which is a composite of a toner core and a colorant layer (a colorant layer containing carbon black) disposed over a surface of the toner core. The colorant layers have a thickness of at least 200 nm. Since the outside of the toner core of the composite core in each toner particle has the colorant layer containing carbon black and having a thickness of at least 200 nm, the toner according to the present embodiment is expected to exhibit improved black color developing ability.

Each of the toner particles included in the toner according to the present embodiment also has a shell layer covering a surface of the composite core, and the shell layer includes a repeating unit having a non-ring-opened oxazoline group. The non-ring-opened oxazoline group has strong positive chargeability. The non-ring-opened oxazoline group content is at least 500 μmol and no greater than 1,000 μmol. That is, the shell layer covering the surface of the composite core in each toner particle contains an oxazoline group with strong positive chargeability in a content range suitable for image formation. Since the outside of the colorant layer of each toner particle has the shell layer with strong positive chargeability, the toner according to the present embodiment is expected to exhibit improved positive chargeability even though the outside of the toner core has the colorant layer containing carbon black with relatively high conductivity. Specifically, the toner is expected to be able to maintain an amount of positive charge of the toner particles in a range suitable for image formation.

The colorant layers in the toner according to the present embodiment have a thickness of no greater than 500 nm. Furthermore, the non-ring-opened oxazoline group content of the toner according to the present embodiment is no greater than 1,000 μmol. A shell layer content of the toner particles tends to increase with an increase in the non-ring-opened oxazoline group content. An upper limit of the colorant layer thickness and an upper limit of the non-ring-opened oxazoline group content of the toner according to the present embodiment are set so as not to impair low-temperature fixability of the toner. The toner according to the present embodiment is therefore expected to be able to maintain its low-temperature fixability.

Preferably, each colorant layer covers at least 70% and no greater than 100% of the surface area of the toner core in order to improve black color developing ability of the toner. Preferably, each shell layer covers at least 70% and no greater than 100% of the surface area of the composite core in order to improve positive chargeability of the toner.

The toner core may contain an internal additive (for example, at least one of a colorant, a releasing agent, a charge control agent, and a magnetic powder) as necessary in addition to the binder resin.

The toner particles included in the toner according to the present embodiment may include an external additive. In the case of the toner particles containing an external additive, each toner particle therein includes the external additive and a toner mother particle having a composite core and a shell layer. The external additive adheres to surfaces of the toner mother particles. The external additive may be omitted if not required. In the toner containing no external additive, the toner mother particles are equivalent to the toner particles.

The following describes the toner according to the present embodiment in detail with reference to FIGURE as appropriate.

[Structure of Toner Particles]

The following describes a structure of the toner particles included in the toner according to the present embodiment with reference to FIGURE. FIGURE illustrates an example of a cross-sectional structure of a toner particle included in the toner according to the present embodiment. In order to facilitate explanation, a toner particle 1 illustrated in FIGURE will be described as a toner particle containing no external additive.

The toner particle 1 illustrated in FIGURE includes a composite core 2 and a shell layer 3 covering a surface of the composite core 2. The composite core 2 is a composite of a toner core 4 containing a binder resin and a colorant layer 5 disposed over a surface of the toner core 4. The colorant layer 5 contains carbon black. The colorant layer 5 has a thickness of at least 200 nm and no greater than 500 nm. The colorant layer 5 entirely covers the surface of the toner core 4 in the toner particle 1 illustrated in FIGURE. The shell layer 3 also entirely covers the surface of the colorant layer 5 in the toner particle 1 illustrated in FIGURE. In order to further improve black color developing ability of the toner, the colorant layer 5 preferably has a thickness of at least 350 nm.

In order to obtain a toner suitable for image formation, the toner core 4 preferably has a volume median diameter ($D_{50}$) of at least 4 μm and no greater than 9 μm.

The shell layer 3 includes a repeating unit having a non-ring-opened oxazoline group. The non-ring-opened oxazoline group content is at least 500 μmol and no greater than 1,000 μmol. In order to further improve positive chargeability of the toner, the non-ring-opened oxazoline group content is preferably at least 700 μmol.

In order to obtain a toner suitable for image formation, the shell layer 3 preferably has a thickness of at least 1 nm and no greater than 400 nm. The thickness of the shell layer 3 can be measured by analyzing a transmission electron microscope (TEM) image of a cross-section of the toner particle 1 using commercially available image analysis software (for example, "WinROOF", product of Mitani Corporation). Note that if the thickness of the shell layer 3 is not uniform for a single toner particle 1, the thickness of the shell layer 3 is measured at each of four locations that are approximately evenly spaced and the arithmetic mean of the four measured values is determined to be an evaluation value (the thickness of the shell layer 3) for the toner particle 1. Specifically, the four measurement locations are determined by drawing two straight lines that intersect at right angles at approximately the center of the cross-section of the toner particle 1 and determining four locations at which the two straight lines and the shell layer 3 intersect to be the measurement locations.

An example of the toner particles included in the toner according to the present embodiment has been described above with reference to FIGURE. However, the present disclosure is not limited as such. For example, the toner particles included in the toner according to the present disclosure may include an external additive (not shown). For example, toner particles included in the toner according to the present disclosure may each include the toner particle 1 illustrated in FIGURE as a toner mother particle and have an external additive adhering to a surface of the toner mother particle.

[Components of Toner Particles]

The following describes components of the toner particles included in the toner according to the present embodiment.

{Composite Core}

Each of the composite cores is a composite of a toner core and a colorant layer disposed over a surface of the toner core. The following describes components of the toner cores.

(Binder Resin)

In order to improve low-temperature fixability of the toner, the toner cores preferably contain a thermoplastic resin as a binder resin. More preferably, the thermoplastic resin contained in the toner cores accounts for at least 85% by mass of a total mass of the binder resin. Examples of thermoplastic resins that can be used include styrene-based resins, acrylic acid ester-based resins, olefin-based resins (specific examples include polyethylene resins and polypropylene resins), vinyl resins (specific examples include vinyl chloride resins, polyvinyl alcohol, vinyl ether resins, and N-vinyl resins), polyester resins, polyamide resins, and urethane resins. Furthermore, copolymers of the resins listed above, that is, copolymers obtained through incorporation of a repeating unit into any of the resins listed above (specific examples include styrene-acrylic acid ester-based resins and styrene-butadiene-based resins) may be used as the binder resin.

A thermoplastic resin can be obtained through addition polymerization, copolymerization, or polycondensation of at least one thermoplastic monomer. Note that the thermoplastic monomer means a monomer that forms a thermoplastic resin through homopolymerization (specific examples include acrylic acid ester-based monomers and styrene-based monomers) or a monomer that forms a thermoplastic resin through polycondensation (for example, a combination of a polyhydric alcohol and a polycarboxylic acid that form a polyester resin through polycondensation).

In order to improve low-temperature fixability of the toner, the toner cores preferably contain a polyester resin as the binder resin. In order to inhibit detachment of the shell layers from the composite cores in toner particles in which each colorant layer does not entirely cover the surface of the toner core, the toner cores preferably contain a polyester resin having an acid value of at least 5 mgKOH/g as the binder resin, and more preferably contain a polyester resin having an acid value at least 5 mgKOH/g and no greater than 8 mgKOH/g as the binder resin. The polyester resin having an acid value of at least 5 mgKOH/g tends to form bonds described below with the shell layers through a reaction with the non-ring-opened oxazoline group.

The polyester resin is obtained through polycondensation of at least one polyhydric alcohol and at least one polycarboxylic acid. Examples of alcohols that can be used for synthesis of the polyester resin include dihydric alcohols (specific examples include diols and bisphenols) and tri- or higher-hydric alcohols listed below. Examples of carboxylic acids that can be used for synthesis of the polyester resin include dibasic carboxylic acids and tri- or higher-basic carboxylic acids listed below. Note that a derivative of a polycarboxylic acid that can form an ester bond through polycondensation, such as a polycarboxylic acid anhydride or a polycarboxylic acid halide, may be used instead of a polycarboxylic acid.

Examples of preferable diols include ethylene glycol, diethylene glycol, triethylene glycol, 1,2-propanediol, 1,3-propanediol, 1,4-butanediol, neopentyl glycol, 2-butene-1,4-diol, 1,5-pentanediol, 2-pentene-1,5-diol, 1,6-hexanediol, 1,4-cyclohexanedimethanol, dipropylene glycol, 1,4-benzenediol, polyethylene glycol, polypropylene glycol, and polytetramethylene glycol.

Examples of preferable bisphenols include bisphenol A, hydrogenated bisphenol A, bisphenol A ethylene oxide adducts, and bisphenol A propylene oxide adducts.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- and higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Colorant)

The toner cores may contain a black colorant. The black colorant is for example carbon black. The carbon black that may be contained in the toner cores and carbon black that is contained in the colorant layers described below may be the same as or different from each other. In order to form high-quality images using the toner, the black colorant is preferably contained in an amount of at least 1 part by mass and no greater than 20 parts by mass relative to 100 parts by mass of the binder resin. Alternatively, a colorant that is adjusted to a black color using a yellow colorant, a magenta colorant, and a cyan colorant can be used as a black colorant.

(Releasing Agent)

The toner cores may contain a releasing agent. The releasing agent is for example used for improving offset resistance of the toner. In order to improve offset resistance of the toner, the releasing agent is preferably contained in an amount of at least 1 part by mass and no greater than 20 parts by mass relative to 100 parts by mass of the binder resin.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozocerite, ceresin, and petrolatum; ester waxes having a fatty acid ester as a main component such as montanic acid ester wax and castor wax; and waxes in which a part or all of a fatty acid ester has been deoxidized such as deoxidized carnauba wax. According to the present embodiment, one releasing agent may be used independently, or two or more releasing agents may be used in combination.

A compatibilizer may be added to the toner cores in order to improve compatibility between the binder resin and the releasing agent.

(Charge Control Agent)

The toner cores may contain a charge control agent. The charge control agent is for example used in order to improve charge stability and a charge rise characteristic of the toner. The charge rise characteristic of the toner is an indicator as to whether the toner can be charged to a specific charge level in a short period of time. The cationic strength of the toner cores can be increased through the toner cores containing a positively chargeable charge control agent.

Examples of positively chargeable charge control agents that can be used include azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as Azine Fast Red FC, Azine Fast Red 12BK, Azine Violet BO, Azine Brown 3G, Azine Light Brown GR, Azine Dark Green BH/C, Azine Deep Black EW, and Azine Deep Black 3RL; acid dyes such as Nigrosine BK, Nigrosine NB, and Nigrosine Z; metal salts of naphthenic acids; metal salts of higher organic carboxylic acids; alkoxylated amines; alkylamides; and quaternary ammonium salts such as benzyldecylhexylmethyl ammonium chloride, decyltrimethyl ammonium chloride, 2-(methacryloyloxy) ethyltrimethylammonium chloride, and dimethylaminopropyl acrylamide methyl chloride quaternary salt. One of the charge control agents listed above may be used independently, or two or more of the charge control agents listed above may be used in combination.

In order to improve charge stability of the toner, the charge control agent is preferably contained in an amount of at least 0.1 parts by mass and no greater than 20 parts by mass relative to 100 parts by mass of the binder resin.

(Magnetic Powder)

The toner cores may contain a magnetic powder. Examples of materials of the magnetic powder that can be used include ferromagnetic metals (specific examples include iron, cobalt, and nickel) and alloys thereof, ferromagnetic metal oxides (specific examples include ferrite, magnetite, and chromium dioxide), and materials subjected to ferromagnetization (specific examples include carbon materials made ferromagnetic through thermal treatment). According to the present embodiment, one magnetic powder may be used independently, or two or more magnetic powders may be used in combination.

(Colorant Layer)

The following describes the colorant layers. The colorant layers for example contain carbon black as a main component. In order to further improve black color developing ability of the toner, the colorant layers preferably have a carbon black content of at least 70% by mass, more preferably at least 80% by mass, still more preferably at least 90% by mass, and particularly preferably 100% by mass. The colorant layers may contain another component (an optional component) other than the carbon black. The optional component is for example a resin.

In order to inhibit detachment of the shell layers from the composite cores, the carbon black in the colorant layers is preferably an acidic carbon black, more preferably an acidic carbon black having a pH of at least 2.5 and no greater than 5.0, and still more preferably an acidic carbon black having a pH of at least 3.0 and no greater than 4.0. An acidic carbon black has an acidic group such as a carboxy group in a surface thereof, and therefore tends to form bonds described below with the shell layers through a reaction with the non-ring-opened oxazoline group. The value of pH of the acidic carbon black is measured by a pH measurement method in accordance with Japanese Industrial Standard (JIS) Z8802-2011.

The acidic carbon black may for example be a commercially available acidic carbon black. Examples of commercially available acidic carbon blacks that can be used include "MA100" (pH 3.5) manufactured by Mitsubishi Chemical Corporation, "MA14" (pH 3.0) manufactured by Mitsubishi Chemical Corporation, "MA77" (pH 2.5) manufactured by Mitsubishi Chemical Corporation, "SPECIAL BLACK 350" (pH 3.5) manufactured by Degussa, "SPECIAL BLACK 100" (pH 3.3) manufactured by Degussa, "SPECIAL BLACK 250" (pH 3.1) manufactured by Degussa, "SPECIAL BLACK 5" (pH 3.0) manufactured by Degussa, "SPECIAL BLACK 550" (pH 2.8) manufactured by Degussa, "SPECIAL BLACK 6" (pH 2.5) manufactured by Degussa, and "REGAL (registered Japanese trademark) 400R" (pH 4.0) manufactured by Cabot Corporation.

In order to readily adjust the colorant layer thickness within a range of at least 200 nm and no greater than 500 nm, the carbon black is preferably contained in an amount of at least 1.0 part by mass and no greater than 2.0 parts by mass relative to 100 parts by mass of the toner cores.

{Shell Layer}

The following describes the shell layers. The shell layers include a repeating unit having a non-ring-opened oxazoline group. The repeating unit is for example a repeating unit represented by formula (1-1) shown below (referred to below as a repeating unit (1-1)).

(1-1)

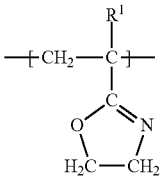

In formula (1-1), $R^1$ represents a hydrogen atom or an alkyl group optionally substituted with a phenyl group. Examples of alkyl groups that may be represented by $R^1$ include a methyl group, an ethyl group, and an isopropyl group. Examples of preferable $R^1$ include a hydrogen atom, a methyl group, an ethyl group, and an isopropyl group.

The repeating unit (1-1) has a non-ring-opened oxazoline group. The non-ring-opened oxazoline group has a ring structure and has strong positive chargeability. The non-ring-opened oxazoline group is reactive with a carboxy group, an aromatic sulfanyl group, and an aromatic hydroxy group. In the case of a toner in which the colorant layers contain an acidic carbon black, for example, a reaction (also referred to below as a reaction RA) tends to occur between the repeating unit (1-1) and the carboxy group in the surfaces of the colorant layers (specifically, the carboxy group in the acidic carbon black) during shell layer formation. In the case of a toner in which the toner cores contain a polyester resin as the binder resin and the colorant layers do not entirely cover the surfaces of the respective toner cores, a reaction (also referred to below as a reaction RB) tends to occur between the repeating unit (1-1) and the carboxy group in exposed regions of the surfaces of the toner cores (specifically, the carboxy group in the polyester resin in the regions not covered with the colorant layers) during shell layer formation. In a situation in which both the reaction RA and the reaction RB occur, the surfaces of the colorant layers and the regions of the surfaces of the toner cores, which are exposed from the colorant layers, are covered with the shell layers.

During the shell layer formation, a reaction between the repeating unit (1-1) and the carboxy group in the surfaces of the colorant layers or the surfaces of the toner cores occurs to cause ring-opening of the oxazoline group, and thus an amide bond and an ester bond are formed between the composite cores and the shell layers as illustrated in formula (1-2) shown below. Formation of such bonds ensures strong bonding between the composite cores and the shell layers, and inhibits detachment of the shell layers from the composite cores. $R^1$ in formula (1-2) shown below is the same as defined for $R^1$ in formula (1-1). An asterisk in formula (1-2) shown below represents a site that is bonded to an atom in the composite cores.

(1-2)

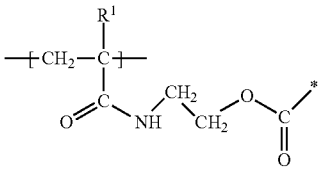

In order to further improve positive chargeability of the toner and inhibit detachment of the shell layers from the composite cores, the shell layers preferably contain a vinyl resin including the repeating unit (1-1) and a repeating unit represented by formula (1-2) (referred to below as a repeating unit (1-2)). The vinyl resin including the repeating unit (1-1) and the repeating unit (1-2) is also referred to below as a specific vinyl resin. The strength of positive chargeability of the specific vinyl resin (that is, positive chargeability of the toner) tends to increase with an increase in a proportion (mole ratio) of the repeating unit (1-1) in the specific vinyl resin. The strength of bonding between the composite cores and the shell layers tends to increase with an increase in a proportion (mole ratio) of the repeating unit (1-2) in the specific vinyl resin. In order to further improve positive chargeability of the toner and further inhibit detachment of the shell layers from the composite cores, the shell layers are preferably composed of the specific vinyl resin, that is, the shell layers preferably include no other resin than the specific vinyl resin. The mole ratio between the repeating unit (1-1) and the repeating unit (1-2) in the specific vinyl resin can for example be adjusted by changing at least one of pH of the carbon black in the colorant layers, the acid value of the binder resin in the toner cores, and an amount of a ring-opening agent (for example, an aqueous acetic acid solution) that is used for the shell layer formation.

Formation of the repeating unit (1-2) through ring-opening of the oxazoline group during the shell layer formation can for example be confirmed by a method described below. First, a specific amount of toner particles (a sample) is dissolved in a solvent. The resultant solution is placed in a test tube for nuclear magnetic resonance (NMR) measurement, and a $^1$H-NMR spectrum is measured using an NMR apparatus. In the $^1$H-NMR spectrum, a triplet signal derived from a secondary amide appears around a chemical shift δ of 6.5. The presence of a triplet signal around a chemical shift δ of 6.5 in the measured $^1$H-NMR spectrum therefore indicates formation of the repeating unit (1-2) through ring-opening of the oxazoline group during the shell layer formation. Measurement conditions for the $^1$H-NMR spectrum are for example as follows.

(Example of Measurement Conditions for $^1$H-NMR Spectrum)

NMR apparatus: Fourier transform nuclear magnetic resonance (FT-NMR) apparatus ("JNM-AL400", product of JEOL Ltd.)

Test tube for NMR measurement: 5-mm test tube

Solvent: Deuterated chloroform (1 mL)

Temperature of sample: 20° C.

Mass of sample: 20 mg

Number of times of accumulation: 128 times

Internal standard substance of chemical shift: Tetramethylsilane (TMS)

Examples of monomers that can be used for formation of the specific vinyl resin include a compound represented by formula (1) shown below (also referred to below as a compound (1)). The compound (1) forms the repeating unit (1-1) through addition polymerization. $R^1$ in formula (1) shown below is the same as defined for $R^1$ in formula (1-1).

(1)

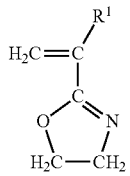

The specific vinyl resin may be a copolymer of the compound (1) and an additional vinyl compound. A vinyl compound refers to a compound having a vinyl group ($CH_2$=CH—) or a substituted vinyl group in which hydrogen is replaced (specific examples include ethylene, propylene, butadiene, vinyl chloride, (meth)acrylic acid, methyl (meth)acrylate, (meth)acrylonitrile, and styrene). The vinyl compound can be formed into a polymer (resin) by addition polymerization through carbon-to-carbon double bonds "C=C" in the vinyl group or the substituted vinyl group.

The additional vinyl compound is preferably at least one vinyl compound selected from the group consisting of alkyl acrylate-based monomers and styrene-based monomers.

Examples of alkyl acrylate-based monomers that can be used include a compound represented by formula (2) shown below (also referred to below as a compound (2)) and a compound represented by formula (3) shown below (also referred to below as a compound (3)).

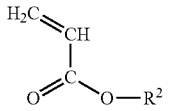

(2)

In formula (2), $R^2$ represents an alkyl group optionally substituted with a substituent. Examples of alkyl groups that may be represented by $R^2$ include a methyl group, an ethyl group, an n-propyl group, an isopropyl group, an n-butyl group, an isobutyl group, and a 2-ethylhexyl group. In a situation in which $R^2$ represents an alkyl group substituted with a substituent, the substituent is for example a hydroxy group. Examples of preferable $R^2$ include a methyl group, an ethyl group, an n-propyl group, an isopropyl group, an n-butyl group, an isobutyl group, a 2-ethylhexyl group, a hydroxyethyl group, a hydroxypropyl group, and a hydroxybutyl group.

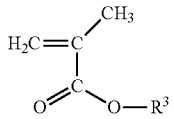

(3)

In formula (3), $R^3$ represents an alkyl group optionally substituted with a substituent. Examples of alkyl groups that may be represented by $R^3$ include a methyl group, an ethyl group, an n-propyl group, an isopropyl group, an n-butyl group, an isobutyl group, and a 2-ethylhexyl group. In a situation in which $R^3$ presents an alkyl group substituted with a substituent, the substituent is for example a hydroxy group. Examples of preferable $R^3$ include a methyl group, an ethyl group, an n-propyl group, an isopropyl group, an n-butyl group, an isobutyl group, a 2-ethylhexyl group, a hydroxyethyl group, a hydroxypropyl group, and a hydroxybutyl group.

An aqueous solution of an oxazoline group-containing polymer ("EPOCROS (registered Japanese trademark) WS series", product of Nippon Shokubai Co., Ltd.) can for example be used as a material for formation of the shell layers containing the specific vinyl resin (also referred to below as a shell material). Among such products, "EPOCROS WS-300" contains a copolymer of 2-vinyl-2-oxazoline (a compound that falls under the compound (1)) and methyl methacrylate (a compound that falls under the compound (3)). "EPOCROS WS-700" contains a copolymer of 2-vinyl-2-oxazoline, methyl methacrylate, and butyl acrylate (a compound that falls under the compound (2)).

{Preferable Combinations of Colorant Layers and Shell Layers}

In order to further improve positive chargeability and black color developing ability of the toner while maintaining low-temperature fixability of the toner, the toner particles preferably include colorant layers that have a thickness of at least 350 nm and no greater than 500 nm, and shell layers that give a non-ring-opened oxazoline group content of at least 700 μmol and no greater than 1,000 μmol. More preferably, for the same reason, the toner particles include colorant layers that have a thickness of at least 350 nm and no greater than 500 nm and that contain an acidic carbon black having a pH of at least 3.0 and no greater than 4.0, and shell layers that give a non-ring-opened oxazoline group content of at least 700 μmol and no greater than 1,000 μmol.

{External Additive}

The toner particles may further include an external additive. The external additive is added for example by using the toner particles 1 illustrated in FIGURE as toner mother particles and stirring the toner mother particles (a powder) and the external additive particles (a powder) together to cause the external additive particles to adhere to surfaces of the toner mother particles.

Preferably, the external additive particles are inorganic particles. Particularly preferably, the external additive particles are silica particles or particles of a metal oxide (specific examples include alumina, titanium oxide, magnesium oxide, zinc oxide, strontium titanate, and barium titanate). According to the present embodiment, one type of external additive particles may be used independently, or two or more types of external additive particles may be used in combination.

In order to allow the external additive to sufficiently exhibit its function while inhibiting detachment of the external additive particles from the toner mother particles, the external additive (in a situation in which plural types of external additive particles are used, a total amount of the external additive particles) is preferably added in an amount of at least 0.5 parts by mass and no greater than 10 parts by mass relative to 100 parts by mass of the toner mother particles.

In order to improve fluidity of the toner, it is preferable to use inorganic particles (a powder) having a number average primary particle diameter of at least 5 nm and no greater than 500 nm as the external additive particles.

The external additive particles may be surface-treated particles. For example, in a situation in which silica particles are used as the external additive particles, either or both of hydrophobicity and positive chargeability may be imparted to surfaces of the silica particles using a surface treatment agent. Examples of surface treatment agents that can be used include coupling agents (specific examples include silane coupling agents, titanate coupling agents, and aluminate coupling agents), silazane compounds (specific examples include chain silazane compounds and cyclic silazane compounds), and silicone oils (specific examples include dimethylsilicone oil). Particularly preferably, the surface treatment agent is a silane coupling agent or a silazane compound. Examples of preferable silane coupling agents include silane compounds (specific examples include methyltrimethoxysilane and aminosilane). Examples of preferable silazane compounds include hexamethyldisilazane (HMDS). When a surface of a silica base (untreated silica particles) is treated with the surface treatment agent, some or all of a large number of hydroxy groups (—OH) present in the surface of the silica base are replaced by functional groups derived from the surface treatment agent. As a result, silica particles having the functional groups derived from the surface treatment agent (specifically, functional groups that are more hydrophobic and/or more readily positively chargeable than the hydroxy groups) in surfaces thereof are obtained.

<Toner Production Method>

The following describes a preferable production method of the toner according to the embodiment described above. Elements that have been already described in the explanation of the toner according to the above embodiment will not be redundantly described below.

[Toner Core Preparation]

First, the toner cores are prepared by an aggregation method or a pulverization method.

The aggregation method for example includes an aggregation process and a coalescing process. In the aggregation process, fine particles of toner core components are caused to aggregate in an aqueous medium to form aggregated particles. In the coalescing process, the components in the aggregated particles are caused to coalesce in the aqueous medium to form toner cores.

The following describes the pulverization method. The toner cores can be prepared relatively easily at a low manufacturing cost by the pulverization method. Toner core preparation by the pulverization method for example includes a melt-kneading process and a pulverizing process. Toner core preparation by the pulverization method may further include a mixing process before the melt-kneading process. Toner core preparation by the pulverization method may further include at least one of a finely pulverizing process and a classification process after the pulverizing process.

In the mixing process, for example, a binder resin and an optional internal additive are mixed to obtain a mixture. In the melt-kneading process, a toner material is melt-kneaded to obtain a melt-kneaded product. The toner material is for example a mixture obtained through the mixing process. In the pulverizing process, the melt-kneaded product obtained as described above is cooled to for example room temperature (25° C.) and pulverized to obtain a pulverized product. In a situation in which the size of the pulverized product obtained through the pulverizing process needs to be reduced, a process of further pulverizing the pulverized product (the finely pulverizing process) may be performed. In a situation in which the size of the pulverized product needs to be uniform, a process of classifying the pulverized product (the classification process) may be performed. The pulverized product obtained through the above-described processes is used as the toner cores.

[Composite Core Preparation]

Next, the toner cores obtained as described above and carbon black are mixed using a mixer (for example, an FM mixer, product of Nippon Coke & Engineering Co., Ltd.) to cause the carbon black adhere to surfaces of the toner cores. Through the above, composite cores each including a toner core and a colorant layer (a layer containing the carbon black) disposed over the surface of the toner core are obtained. The colorant layer thickness can for example be adjusted by changing the amount of the carbon black to add relative to the mass of the toner cores.

[Shell Layer Formation]

Next, the composite cores obtained as described above, an aqueous solution of an oxazoline group-containing polymer as a shell material, and water (for example, ion exchanged water) are placed in a vessel. Next, the internal temperature of the vessel is increased up to a specific temperature (for example, a temperature of at least 50° C. and no greater than 65° C.) while the vessel contents are stirred. The heating is performed at a heating rate of for example at least 0.4° C./minute and no greater than 0.6° C./minute. An aqueous ammonia solution may be added into the vessel as appropriate to maintain the vessel contents at a pH of at least 5 and no greater than 7 while the internal temperature of the vessel is increased. A ring-opening agent (for example, an aqueous acetic acid solution) for promoting ring-opening of the oxazoline group in the shell material may be added during the heating. Alternatively or additionally, a shell material (for example, an aqueous solution of an oxazoline group-containing polymer) may be added during the heating.

While the internal temperature of the vessel is increased up to the specific temperature, some of oxazoline groups present in the molecules of the oxazoline group-containing polymer undergo ring-opening for example as a result of a reaction with carboxy groups present in the surfaces of the composite cores. As a result of the ring-opening of the oxazoline groups, amide bonds and ester bonds are formed between the composite cores and the shell layers containing the oxazoline group-containing polymer. The internal temperature of the vessel is then reduced to room temperature (for example 25° C.) immediately after the internal temperature of the vessel has reached the specific temperature. Subsequently, the vessel contents are filtered (solid-liquid separation) using for example a filter press. The resultant filter cake may be washed with for example ion exchanged water. Subsequently, the resultant filter cake is dried to obtain toner mother particles each including a composite core and a shell layer (specifically, a shell layer including a repeating unit having a non-ring-opened oxazoline group) covering a surface of the composite core.

The non-ring-opened oxazoline group content can for example be adjusted by changing the amount of the shell material to add relative to the mass of the composite cores. The colorant layer thickness can also be adjusted by changing the amount of the shell material to add relative to the mass of the composite cores. The mass of the shell layers covering the surfaces of the composite cores increases, and thus tendency for the carbon black to be inhibited from being detached from the toner cores in the shell layer formation increases with an increase in the amount of the shell material to add relative to the mass of the composite cores.

The non-ring-opened oxazoline group content can for example be adjusted also by promoting ring-opening of some of the non-ring-opened oxazoline groups in the shell layers using the above-mentioned ring-opening agent. The mole ratio between for example the repeating unit (1-1) and the repeating unit (1-2) described above can also be adjusted through adjustment of the non-ring-opened oxazoline group content using the ring-opening agent.

[External Additive Addition]

Thereafter, as necessary, an external additive may be caused to adhere to the surfaces of the toner mother particles obtained as described above by mixing the toner mother particles and the external additive using a mixer (for example, an FM mixer, product of Nippon Coke & Engineering Co., Ltd.). Note that the toner mother particles may be used as toner particles without undergoing external additive addition. Through the above, the toner (a powder of toner particles) according to the embodiment described above is obtained.

EXAMPLES

The following describes Examples of the present disclosure and Comparative Examples.

<Preparation of Toner Cores TC>

A four-necked flask having a capacity of 5 L and equipped with a thermometer (a thermocouple), a drainage tube, a nitrogen inlet tube, a rectification column, and a stirrer was placed in a thermostat bath and charged with 1,270 g of 1,2-propanediol, 1,750 g of terephthalic acid, and 3.2 g of tin(II) dioctanoate. Subsequently, the flask contents were caused to undergo a reaction (specifically, a condensation reaction) for 14 hours at a temperature of 200° C. in a nitrogen atmosphere. Subsequently, the internal pressure of the flask was reduced, and the flask contents were caused to react at a temperature of 200° C. in the reduced pressure atmosphere (pressure: 8.0 kPa) until Tm of a reaction product (a polyester resin) was a specific temperature (90° C.). As a result, a polyester resin was obtained. The resultant polyester resin had a Tg of 40° C., a Tm of 90° C., and an acid value of 7 mgKOH/g.

An FM mixer ("FM-20B", product of Nippon Coke & Engineering Co., Ltd.) was used to mix 87 parts by mass of the polyester resin obtained as described above, 5 parts by mass of a releasing agent ("NISSAN ELECTOL (registered Japanese trademark) WEP-3", product of NOF Corporation, ester wax having a melting point of 73° C.), and 8 parts by mass of an acidic carbon black ("MA100", product of Mitsubishi Chemical Corporation, pH 3.5) at a rotational speed of 1,200 rpm for 3 minutes.

Subsequently, the resultant mixture was melt-kneaded using a twin-screw extruder ("PCM-30", product of Ikegai Corp.) under conditions of a material feeding rate of 6 kg/hour, a shaft rotational speed of 180 rpm, and a cylinder temperature of 130° C. Thereafter, the resultant melt-kneaded product was cooled. After cooling, the melt-kneaded product was coarsely pulverized using a pulverizer ("ROTOPLEX (registered Japanese trademark)", product of Hosokawa Micron Corporation) under a condition of a set particle diameter of 1.5 mm. The resultant coarsely pulverized product was finely pulverized using a pulverizer ("TURBO MILL Type RS", product of FREUND-TURBO CORPORATION). Subsequently, the resultant finely pulverized product was classified using a classifier ("ELBOW JET Type EJ-LABO", product of Nittetsu Mining Co., Ltd.). As a result, toner cores TC having a volume median diameter ($D_{50}$) of 7.0 μm and a Tg of 43° C. were obtained.

<Preparation of Composite Cores CC-1>

An FM mixer ("FM-20B", product of Nippon Coke & Engineering Co., Ltd.) was used to mix 100 parts by mass of the toner cores TC and 0.5 parts by mass of an acidic carbon black ("MA100", product of Mitsubishi Chemical Corporation) at a rotational speed of 500 rpm for 3 minutes to obtain a powder of composite cores CC-1. The composite cores CC-1 included the toner cores TC and colorant layers (layers composed of the acidic carbon black) disposed over surfaces of the respective toner cores.

<Preparation of Composite Cores CC-2>

A powder of composite cores CC-2 was obtained according to the same method as the preparation of the composite cores CC-1 in all aspects other than that the amount of the acidic carbon black ("MA100", product of Mitsubishi Chemical Corporation) was changed to 1.0 part by mass. The composite cores CC-2 included the toner cores TC and colorant layers (layers composed of the acidic carbon black) disposed over surfaces of the respective toner cores TC.

<Preparation of Composite Cores CC-3>

A powder of composite cores CC-3 was obtained according to the same method as the preparation of the composite cores CC-1 in all aspects other than that the amount of the acidic carbon black ("MA100", product of Mitsubishi Chemical Corporation) was changed to 1.5 parts by mass. The composite cores CC-3 included the toner cores TC and colorant layers (layers composed of the acidic carbon black) disposed over surfaces of the respective toner cores TC.

<Preparation of Composite Cores CC-4>

A powder of composite cores CC-4 was obtained according to the same method as the preparation of the composite cores CC-1 in all aspects other than that the amount of the acidic carbon black ("MA100", product of Mitsubishi Chemical Corporation) was changed to 2.0 parts by mass. The composite cores CC-4 included the toner cores TC and colorant layers (layers composed of the acidic carbon black) disposed over surfaces of the respective toner cores TC.

<Preparation of Composite Cores CC-5>

A powder of composite cores CC-5 was obtained according to the same method as the preparation of the composite cores CC-1 in all aspects other than that 1.0 part by mass of an acidic carbon black ("MA14", product of Mitsubishi Chemical Corporation, pH 3.0) was used instead of 0.5 parts by mass of the acidic carbon black ("MA100", product of Mitsubishi Chemical Corporation). The composite cores CC-5 included the toner cores TC and colorant layers (layers composed of the acidic carbon black) disposed over surfaces of the respective toner cores TC.

<Production of Toner TA-1>

A three-necked flask having a capacity of 1 L and equipped with a thermometer and a stirring impeller was charged with 200 g of the composite cores CC-2, 5 g of an aqueous solution of an oxazoline group-containing polymer ("EPOCROS (registered Japanese trademark) WS-300", product of Nippon Shokubai Co., Ltd., solid concentration: 10% by mass), and 600 mL of ion exchanged water. Next, the flask was placed in a thermostat bath, and the internal temperature of the flask was increased from 25° C. to 63° C. at a heating rate of 0.5° C./minute while the flask contents were stirred at a rotational speed of 200 rpm. During the heating, an aqueous ammonia solution (concentration: 1% by mass) was added into the flask as appropriate in order to maintain the flask contents at pH 6. The internal temperature of the flask was cooled to 25° C. at a cooling rate of 2° C./minute immediately after the internal temperature of the flask had reached 63° C. After cooling, the flask contents were filtered (solid-liquid separation) using a filter press ("TFP310-3MKII", product of Hitachi Zosen Corporation). The resultant filter cake was washed with ion exchanged water until the electrical conductivity of the filtrate was 2 S/cm. The resultant filter cake was dried at a pressure of 0.09 MPa and a temperature of 40° C. using a vacuum dryer. The drying was continued until the moisture content of the filter cake was 0.5% by mass. As a result, a powder of toner mother particles including the composite cores CC-2 and shell layers (shell layers including a repeating unit having a non-ring-opened oxazoline group) covering the respective composite cores CC-2 was obtained.

An FM mixer ("FM-10B", product of Nippon Coke & Engineering Co., Ltd.) was used to mix 100 parts by mass of the toner mother particles obtained as described above, 1.5 parts by mass of silica particles ("AEROSIL (registered Japanese trademark) REA90", product of Nippon Aerosil Co., Ltd., silica particles made positively chargeable using a surface treatment agent), and 1.5 parts by mass of conductive titanium oxide particles ("EC-100", product of Titan Kogyo, Ltd.) for 2 minutes under conditions of a rotational speed of 3,000 rpm and a jacket temperature of 20° C. The mixing caused the external additives (a powder of silica particles and a powder of conductive titanium oxide particles) to adhere to the surfaces of the toner mother particles. Subsequently, sifting was performed on the resultant powder using a 300-mesh sieve (pore size: 48 μm). As a result, a positively chargeable toner TA-1 was obtained.

<Production of Toners TA-2 to TA-8 and TB-1 to TB-12>

Toners TA-2 to TA-8 and TB-1 to TB-12 were obtained according to the same method as the production of the toner TA-1 in all aspects other than that either or both of the type of composite cores and the amount of the aqueous solution of an oxazoline group-containing polymer ("EPOCROS (registered Japanese trademark) WS-300", product of Nippon Shokubai Co., Ltd., solid concentration: 10% by mass) were changed as shown in Table 1. The toners TA-2 to TA-8 and TB-1 to TB-12 were all positively chargeable toners.

<Measurement of Colorant Layer Thickness>

With respect to each of the toners TA-1 to TA-8 and TB-1 to TB-12, the toner as a measurement target was dispersed in a visible light curing resin ("ARONIX (registered Japanese trademark) LCR D-800", product of Toagosei Co., Ltd.), and then the resin was caused to cure through visible light irradiation to obtain a hardened material. Subsequently, the hardened material was cut using an ultramicrotome ("EM UC6", product of Leica Microsystems) equipped with a diamond knife to obtain a flake sample having a thickness of 150 nm. Subsequently, an image of a cross-section of the resultant flake sample was captured at a magnification of 100,000× using a transmission electron microscope (TEM) ("H-7100FA", product of Hitachi High-Technologies Corporation.). The colorant layer thickness was measured by analyzing the TEM image using image analysis software ("WinROOF", product of Mitani Corporation). Specifically, 10 locations for measurement of the colorant layer thickness in a cross-section of one toner particle in the TEM image were randomly selected, and the colorant layer thickness was measured at each of the selected measurement locations. An arithmetic mean of the thickness values measured at the 10 locations was determined to be a colorant layer thickness of the toner particle. The colorant layer thickness of each of five toner particles included in the measurement target toner was measured, and a number average of the thus measured thickness values was determined to be an evaluation value (a colorant layer thickness) of the measurement target toner. Results are shown in Table 1. In each toner particle in the TEM images of the toners TA-1 to TA-8, the colorant layer covered at least 70% and no greater than 100% of the surface area of the toner core TC (an area defined by an outline representing a periphery of the toner core TC). Also, in each toner particle in the TEM images of the toners TA-1 to TA-8, the shell layer covered at least 70% and no greater than 100% of the surface area of the composite core (an area defined by an outline representing a periphery of the composite core).

<Measurement of Non-Ring-Opened Oxazoline Group Content>

With respect to each of the toners TA-1 to TA-8 and TB-1 to TB-12, the non-ring-opened oxazoline group content was measured by gas chromatography-mass spectrometry (GC/MS). In GC/MS, a gas chromatograph mass spectrometer ("GCMS-QP2010 Ultra", product of Shimadzu Corporation) and a multi-shot pyrolyzer ("FRONTIER LAB MULTI-FUNCTIONAL PYROLYZER (registered Japanese trademark) PY-3030D", product of Frontier Laboratories Ltd.) were used as measuring devices. A GC column ("AGILENT (registered Japanese trademark) J&W Ultra-inert Capillary GC Column DB-5 ms", product of Agilent Technologies Japan, Ltd., phase: allylene phase having a polymer main chain strengthened by introducing allylene to siloxane polymer, inner diameter: 0.25 mm, film thickness: 0.25 jam, length: 30 m) was used. Conditions for gas chromatography and mass spectrometry are shown below.

[Conditions for Gas Chromatography]

Carrier gas: Helium (He) gas

Carrier flow rate: 1 mL/minute

Vaporizing chamber temperature: 210° C.

Thermal decomposition temperature: 600° C. in heating furnace, 320° C. in interface portion Heating condition: Temperature kept at 40° C. for 3 minutes, increased from 40° C. to 300° C. at a rate of 10° C./minute, and kept at 300° C. for 15 minutes

[Conditions for Mass Spectrometry]

Ionization method: Electron impact (EI) method

Ion source temperature: 200° C.

Interface portion temperature: 320° C.

Detection mode: Scan (measurement range: from 45 m/z to 500 m/z)

The non-ring-opened oxazoline group content of a measurement target (each toner) (an amount of the non-ring-opened oxazoline group contained in 1 g of the toner) was determined based on a peak area of a measured chromatogram by identifying a peak unique to the non-ring-opened oxazoline group through analysis of a mass spectrum measured under the above conditions. The quantitative determination of the non-ring-opened oxazoline group content was performed using a calibration curve. Results are shown in Table 1.

TABLE 1

| Toner | Composite core | Amount of aqueous solution of oxazoline group-containing polymer [g] | Colorant layer thickness [nm] | Non-ring-opened oxazoline group content [μmol] |
|---|---|---|---|---|
| TA-1 | CC-2 | 5 | 200 | 702 |
| TA-2 | CC-2 | 8 | 240 | 980 |
| TA-3 | CC-3 | 2 | 390 | 532 |
| TA-4 | CC-3 | 5 | 400 | 743 |
| TA-5 | CC-3 | 8 | 420 | 993 |
| TA-6 | CC-4 | 2 | 490 | 538 |
| TA-7 | CC-5 | 5 | 210 | 724 |
| TA-8 | CC-5 | 8 | 210 | 990 |
| TB-1 | CC-1 | 2 | 110 | 480 |
| TB-2 | CC-1 | 5 | 110 | 664 |
| TB-3 | CC-1 | 8 | 110 | 893 |
| TB-4 | CC-1 | 12 | 120 | 1148 |
| TB-5 | CC-2 | 2 | 200 | 490 |
| TB-6 | CC-2 | 12 | 240 | 1224 |
| TB-7 | CC-3 | 12 | 420 | 1302 |
| TB-8 | CC-4 | 5 | 520 | 764 |
| TB-9 | CC-4 | 8 | 520 | 1008 |
| TB-10 | CC-4 | 12 | 520 | 1325 |
| TB-11 | CC-5 | 2 | 190 | 503 |
| TB-12 | CC-5 | 12 | 220 | 1238 |

<Evaluation Methods>

[Preparation of Two-Component Developer]

With respect to each of the toners TA-1 to TA-8 and TB-1 to TB-12, 8 parts by mass of the toner for evaluation and 100 parts by mass of a developer carrier (a carrier for "TASKalfa7551ci", product of KYOCERA Document Solutions Inc.) were mixed for 30 minutes using a ball mill to prepare a two-component developer for evaluation.

[Evaluation of Positive Chargeability]

A multifunction peripheral ("TASKalfa7551ci", product of KYOCERA Document Solutions Inc.) was used as an evaluation apparatus. The two-component developer prepared as described above was loaded into a black-color developing device of the evaluation apparatus, and toner for replenishment use (the toner being evaluated) was loaded into a black-color toner container of the evaluation apparatus. Next, an image having a coverage of 8% was printed on 100,000 successive sheets of printing paper (A4 size) using the evaluation apparatus under environmental conditions of a temperature of 25° C. and a relative humidity of 50%.

Next, the two-component developer was taken out of the black-color developing device of the evaluation apparatus, and then the amount of charge (unit: μC/g) of the toner in the two-component developer was measured using a Q/m meter ("MODEL 210HS", product of TREK, INC.) under environmental conditions of a temperature of 25° C. and a relative humidity of 50%. Specifically, 0.10 g of the two-component developer was loaded into a measurement cell of the Q/m meter, and only the toner in the loaded two-component developer was sucked through a sieve (metal mesh) for 10 seconds. The amount of charge (unit: μC/g) of the toner was calculated in accordance with the following expression: "total amount of electricity of sucked toner (unit: μC)/mass of sucked toner (unit: g)". Results are shown in Table 2. The toner was evaluated as "having excellent positive chargeability" if the amount of charge thereof was at least 20 μC/g and no greater than 30 μC/g. The toner was evaluated as "having poor positive chargeability" if the amount of charge thereof was less than 20 μC/g or greater than 30 μC/g.

[Measurement of Charge Decay Constant]

A charge decay constant of the toner as an evaluation target was measured by a method in accordance with Japanese Industrial Standard (JIS) C 61340-2-1 using an electrostatic diffusivity measuring device ("NS-D100", product of Nano Seeds Corporation). Specifically, with respect to each of the toners TA-1 to TA-8 and TB-1 to TB-12, a sample (the toner) was placed in a measurement cell, and the measurement cell containing the sample was left to stand for 12 hours under environmental conditions of a temperature of 32.5° C. and a relative humidity of 80%. Subsequently, the measurement cell was set in the electrostatic diffusivity measuring device, and zeroing of a surface electrometer of the electrostatic diffusivity measuring device was performed. Subsequently, the sample was positively charged by corona discharge under conditions of a voltage of 10 kV and a charging time of 0.5 seconds. The surface potential of the sample was measured continuously starting from 0.7 seconds after completion of the corona discharge under conditions of a sampling frequency of 10 Hz and a measurement time of 300 seconds. The measurement was carried out under environmental conditions of a temperature of 32.5° C. and a relative humidity of 80%. A charge decay constant α for a decay time of 2 seconds (from when the measurement was started to when two seconds elapsed) was calculated based on data of the measured surface potential and the following formula: $V=V_0\exp(-\alpha\sqrt{t})$. Results are shown in Table 2. In the formula, V represents surface potential [unit: V], $V_0$ represents initial surface potential [unit: V], and t represents decay time [unit: second].

The toner was evaluated as "good" in terms of charge decay if the charge decay constant α thereof was less than 0.030, and as "not good" if the charge decay constant α thereof was 0.030 or greater. A toner having a smaller charge decay constant α has a lower charge decay rate.

[Evaluation of Low-Temperature Fixability]

A printer (an evaluation apparatus obtained by modifying "FS-C5250DN", product of KYOCERA Document Solutions Inc., to enable adjustment of fixing temperature) having a roller-roller type heat-pressure fixing device was used as an evaluation apparatus. The two-component developer prepared as described above was loaded into a black-color developing device of the evaluation apparatus, and toner for replenishment use (the toner being evaluated) was loaded into a black-color toner container of the evaluation apparatus.

A solid image (specifically, an unfixed toner image) having a size of 25 mm×25 mm was formed on evaluation paper ("COLORCOPY (registered Japanese trademark)", product of Mondi, A4 size, basis weight: 90 g/m$^2$) using the evaluation apparatus at a toner application amount of 1.0 mg/cm$^2$ under environmental conditions of a temperature of 23° C. and a relative humidity of 50%. Subsequently, the evaluation paper with the image formed thereon was passed through the fixing device of the evaluation apparatus. The lowest temperature at which the solid image (the toner image) was fixable to the evaluation paper (a minimum fixable temperature) was measured by increasing the fixing temperature of the fixing device from 100° C. in increments of 1° C. and determining whether or not the toner was fixable at each fixing temperature. Determination of whether or not the toner was fixable was carried out through a fold-rubbing test described below. Specifically, the evaluation paper passed through the fixing device was folded in half with a surface having the image formed thereon facing inward at a folding line crossing a center of the image, and a 1-kg brass weight covered with cloth was rubbed back and forth on the fold five times. Subsequently, the evaluation paper was opened up and a fold portion (a portion on which the solid image was formed) of the evaluation paper was observed. Then, the length of toner peeling of the fold portion (peeling length) was measured. The minimum fixable temperature was determined to be the lowest temperature among fixing temperatures for which the peeling length was no greater than 1 mm. Results are shown in Table 2. The toner was evaluated as "being able to maintain low-temperature fixability" if the minimum fixable temperature thereof was lower than 130° C., and as "being unable to maintain low-temperature fixability" if the minimum fixable temperature thereof was 130° C. or higher.

[Evaluation of Black Color Developing Ability]

A printer (an evaluation apparatus obtained by modifying "FS-C5250DN", product of KYOCERA Document Solutions Inc., to enable adjustment of fixing temperature) having a roller-roller type heat-pressure fixing device was used as an evaluation apparatus. The two-component developer prepared as described above was loaded into a black-color developing device of the evaluation apparatus, and toner for replenishment use (the toner being evaluated) was loaded into a black-color toner container of the evaluation apparatus.

An evaluation pattern was printed on evaluation paper ("COLORCOPY (registered Japanese trademark)", product of Mondi, A4 size, basis weight: 90 g/m$^2$) using the evaluation apparatus under environmental conditions of a temperature of 23° C. and a relative humidity of 50%. Printing conditions were as shown below. Through the above, an image to be used in the evaluation was obtained.

(Printing Conditions)

Toner application amount: 0.5 mg/cm$^2$

Surface temperature of heating roller (fixing temperature): 150° C.

Surface temperature of pressure roller: 130° C.

Nip width of fixing device: 6.2 mm

Fixing pressure (nip pressure): 150 N

Evaluation pattern: A solid image having a size of 20 mm×30 mm

Five locations for measurement of an L* value were randomly selected on the solid image obtained as described above, and the L* value was measured at each of the selected measurement locations under conditions shown below. Then, an arithmetic mean of the L* values measured at the five locations was determined to be an evaluation value (L* value) of the toner as the evaluation target. Results are shown in Table 2.

(Conditions for L* Value Measurement)

Measuring device: Reflectance densitometer ("Spectro-Eye (registered Japanese trademark)", product of X-Rite Inc.)

Observation light source: D50 (color temperature: 5,000 K)

Observer: 2°

Density Standard: DIN16536 (1995)

White standard: Absolute white standard (Abs)

Filter: Polarization filter (POL)

The toner was evaluated as "having excellent black color developing ability" if the L* value was 18.0 or smaller, and as "having poor black color developing ability" if the L* value was greater than 18.0.

TABLE 2

| | Toner | Positive chargeability (amount of charge) [μC/g] | Charge decay constant α | Low-temperature fixability (minimum fixable temperature) [° C.] | Black color developing ability (L* value) |
|---|---|---|---|---|---|
| Example 1 | TA-1 | 23 | 0.020 | 127 | 17.9 |
| Example 2 | TA-2 | 28 | 0.026 | 128 | 17.6 |
| Example 3 | TA-3 | 20 | 0.021 | 127 | 16.9 |
| Example 4 | TA-4 | 23 | 0.023 | 128 | 16.6 |
| Example 5 | TA-5 | 29 | 0.029 | 129 | 16.8 |
| Example 6 | TA-6 | 20 | 0.022 | 128 | 16.1 |
| Example 7 | TA-7 | 24 | 0.020 | 127 | 17.9 |
| Example 8 | TA-8 | 29 | 0.025 | 129 | 17.8 |
| Comparative Example 1 | TB-1 | 19 | 0.017 | 124 | 19.2 |
| Comparative Example 2 | TB-2 | 22 | 0.019 | 126 | 19.2 |
| Comparative Example 3 | TB-3 | 24 | 0.024 | 127 | 19.1 |
| Comparative Example 4 | TB-4 | 31 | 0.035 | 130 | 19.0 |
| Comparative Example 5 | TB-5 | 19 | 0.018 | 125 | 17.8 |
| Comparative Example 6 | TB-6 | 32 | 0.043 | 136 | 17.6 |
| Comparative Example 7 | TB-7 | 35 | 0.048 | 136 | 16.6 |
| Comparative Example 8 | TB-8 | 23 | 0.025 | 131 | 16.0 |
| Comparative Example 9 | TB-9 | 29 | 0.033 | 135 | 16.0 |
| Comparative Example 10 | TB-10 | 35 | 0.046 | 139 | 15.9 |
| Comparative Example 11 | TB-11 | 20 | 0.018 | 125 | 18.2 |
| Comparative Example 12 | TB-12 | 33 | 0.044 | 137 | 17.8 |

In each of the toner particles included in the toners TA-1 to TA-8, the shell layer included a repeating unit having a non-ring-opened oxazoline group. In each of the toner particles included in the toners TA-1 to TA-8, as shown in Table 1, the colorant layer (a layer composed of an acidic carbon black) had a thickness of at least 200 nm and no greater than 500 nm. In the toner particles included in the toners TA-1 to TA-8, the non-ring-opened oxazoline group content was at least 500 μmol and no greater than 1,000 μmol.

As shown in Table 2, the amount of charge of each of the toners TA-1 to TA-8 was at least 20 μC/g and no greater than 30 μC/g. That is, the toners TA-1 to TA-8 had excellent positive chargeability. The minimum fixable temperature of each of the toners TA-1 to TA-8 was lower than 130° C. That is, each of the toners TA-1 to TA-8 was able to maintain its low-temperature fixability. The L* value of each of the toners TA-1 to TA-8 was smaller than 18.0. That is, the toners TA-1 to TA-8 had excellent black color developing ability.

In each of the toners TB-1 to TB-4 and TB-11, as shown in Table 1, the colorant layers (layers composed of an acidic carbon black) had a thickness of less than 200 nm. In each of the toners TB-8 to TB-10, the colorant layers (layers composed of an acidic carbon black) had a thickness of greater than 500 nm. The toners TB-1 and TB-5 each had a non-ring-opened oxazoline group content of less than 500 μmol. The toners TB-4, TB-6, TB-7, TB-9, TB-10, and TB-12 each had a non-ring-opened oxazoline group content of greater than 1,000 μmol.

As shown in Table 2, the amount of charge of each of the toners TB-1 and TB-5 was less than 20 μC/g. That is, the toners TB-1 and TB-5 had poor positive chargeability. The amount of charge of each of the toners TB-4, TB-6, TB-7, TB-10, and TB-12 was greater than 30 μC/g. That is, the toners TB-4, TB-6, TB-7, TB-10, and TB-12 had poor positive chargeability. The minimum fixable temperature of each of the toners TB-4, TB-6 to TB-10, and TB-12 was 130° C. or higher. That is, each of the toners TB-4, TB-6 to TB-10, and TB-12 was not able to maintain its low-temperature fixability. The L* value of each of the toners TB-1 to TB-4 and TB-11 was greater than 18.0. That is, the toners TB-1 to TB-4 and TB-11 had poor black color developing ability.

These results indicate that the toners according to the present disclosure can exhibit improved positive chargeability and improved black color developing ability while maintaining their low-temperature fixability.

What is claimed is:

1. A positively chargeable toner comprising toner particles, wherein each of the toner particles includes a composite core and a shell layer covering a surface of the composite core, each of the composite cores is a composite of a toner core containing a binder resin and a colorant layer disposed over a surface of the toner core, the colorant layers contain carbon black, the colorant layers have a thickness of at least 200 nm and no greater than 500 nm, the shell layers include a repeating unit having a non-ring-opened oxazoline group, and an amount of the non-ring-opened oxazoline group contained in 1 g of the positively chargeable toner as measured by gas chromatography-mass spectrometry is at least 500 μmol and no greater than 1,000 μmol.

2. The positively chargeable toner according to claim 1, wherein the repeating unit having a non-ring-opened oxazoline group is a repeating unit represented by formula (1-1) shown below, (1-1)

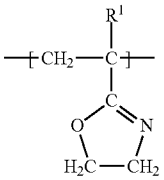

where in formula (1-1), $R^1$ represents a hydrogen atom or an alkyl group optionally substituted with a phenyl group.

3. The positively chargeable toner according to claim 1, wherein the carbon black contained in the colorant layers is an acidic carbon black.

4. The positively chargeable toner according to claim 3, wherein the acidic carbon black has a pH of at least 2.5 and no greater than 5.0.

5. The positively chargeable toner according to claim 1, wherein the binder resin includes a polyester resin, and the polyester resin has an acid value of at least 5 mgKOH/g.

6. The positively chargeable toner according to claim 1, wherein the colorant layers have a thickness of at least 350 nm and no greater than 500 nm, the carbon black contained in the colorant layers is an acidic carbon black having a pH of at least 3.0 and no greater than 4.0, and the amount of the non-ring-opened oxazoline group is at least 700 μmol and no greater than 1,000 μmol.

* * * * *